United States Patent [19]

Tommasini

[11] Patent Number: 4,780,704

[45] Date of Patent: Oct. 25, 1988

[54] WALLET ANTI-THEFT DEVICE

[76] Inventor: Giorgio Tommasini, Cannaregio 6271, 30121 Venezia, Italy

[21] Appl. No.: 62,397

[22] Filed: Jun. 15, 1987

Related U.S. Application Data

[63] Continuation of Ser. No. 772,421, Sep. 4, 1985, abandoned.

[51] Int. Cl.[4] ..... G08B 13/14

[52] U.S. Cl. ..... 340/572; 340/568; 340/574

[58] Field of Search ..... 340/572, 568, 571, 574; 335/205

[56] References Cited

U.S. PATENT DOCUMENTS 3,530,451 9/1970 Devine ..... 340/572 X
3,851,326 11/1974 Costa ..... 340/571
4,090,183 5/1978 Miller ..... 340/571
4,584,571 4/1986 Smit et al. ..... 340/568 X
4,633,232 12/1986 Nelson et al. ..... 340/571 X

*Primary Examiner*—Glen R. Swann, III
*Assistant Examiner*—Thomas J. Mullen, Jr.
*Attorney, Agent, or Firm*—William F. Frank

[57] ABSTRACT

The present invention is similar to the prior art devices in that it is a two part system. One part is a small and elongated magnet which is placed in the wallet. The other part is the electronic circuitry and audio producing device in which the circuit activating switch is held open as long as the wallet with its magnet is in proximity to the second part. When the wallet and the signaling device are separated sufficiently, the magnet no longer holds the activated switch open and the switch closes thus producing the audio signal.

6 Claims, 1 Drawing Sheet

WALLET ANTI-THEFT DEVICE

CROSS REFERENCE TO RELATED APPLICATIONS

This is a continuation of U.S. application Ser. No. 772,421, filed Sept. 4, 1985, and now abandoned.

FIELD OF INVENTION

The present invention is in the generalized field of security devices and more specifically a device to warn an owner when the wallet has been removed from the pocket or a purse or the wallet has accidentally fallen out of the pocket or purse.

BACKGROUND OF INVENTION

A thief's removal of a wallet from the pocket of the owner is very common among men, and theft of a wallet from a purse is more common among women rather than taken of a purse. One reason for the selectivity of not removing a purse is that current fashion has dictated the wearing of purses with shoulder straps thus giving the wearer more leverage to resist someone taking the entire purse as well as more time to take a firm grip on the purse and/or strap. To combat the loss of wallets there have been presented several devices.

U.S. Pat. No. 3,930,249 discloses a wallet anti-theft device which is activated by a photo cell receiving light when the wallet is drawn from the pocket or purse. The photo cell activates a circuit in an oscillating manner which in turn activates an audio producing device which alerts the owner to the attempt of theft of the wallet.

U.S. Pat. No. 4,080,595 discloses a wallet alarm device which is attached by a flexible chain to the billfold. When the attempt is made to take the wallet from the pocket or purse, the flexible chain is extended a given amount and then it activates the audio alarm system. The device is also provided with an on/off switch so the owner does not set off the alarm when removing the wallet for his own purposes.

U.S. Pat. No. 4,090,183 discloses yet another alarm device which utilizes a spring clip to hold a wallet within the device and utilizes a mechanical switch to activate the alarm. The mechanical switch attaches to the lining of the pocket or the purse and when the attempt is made to remove the wallet, the wallet is removed from the mechanical switch thereby activating the alarm. The device has a control lever which permits the owner to release the spring clip holding the billfold against the device so that it may be removed without activating the alarm. The device also has an on/off switch for activating the circuit of the alarm. All three of these devices utilize the small batteries common to calculators, digital watches, and the like.

The disadvantages of a current device discussed above lies is generally the cumbersome nature of the device itself. In the device disclosed in the U.S. Pat. No. 4,090,183 the wallet and the alarm system are one and the same and is most probable that the would-be thief would feel the device in the attempt to remove the wallet which might dissuade him from doing it anyway. The device shown in U.S. Pat. No. 3,930,249 is in one outer wall of the wallet and the would-be thief might be able to detect that there was something other than a wallet involved. Also, its quite possible that in removing the wallet, he could cover, by accident, the access to the photo electric cell and of course prevent the device from working. The device in U.S. Pat. No. 4,080,595, part of which is clipped to the wallet, might indicate to the would be thief that the wallet is attached to something and this would of course this would be a deterrent in itself.

SUMMARY OF THE PRESENT INVENTION

The present invention is similar to the prior art devices in that it is a two part system. One part is a small and elongated magnet which is placed in the wallet. The second part is the electronic circuitry and audio producing device in which the circuit activating switch is held closed as long as the wallet with its magnet is in proximity to the second part. When the wallet and the signaling device are separated sufficiently, the magnet no longer holds the activated switch closed and the switch opens thus producing the audio signal.

BRIEF DESCRIPTION OF THE DRAWINGS

The present invention may be seen in the accompanying drawings by way of an illustrative embodiment which is considered not to be limiting as to the scope of the present invention.

DETAILED DESCRIPTION OF THE INVENTION

Figure 1:
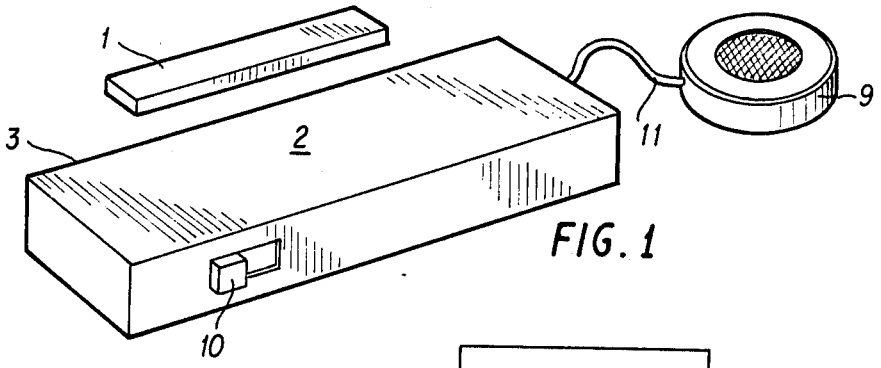
FIG. 1 is a perspective view of the present invention.

Referring to FIG. 1, the present invention comprises an elongated thin magnet 1 and an electronic audio producing component 2 in a housing 3 which is activated when magnet 1 is removed a pre-determined distance from the device 2.

Figure 2:
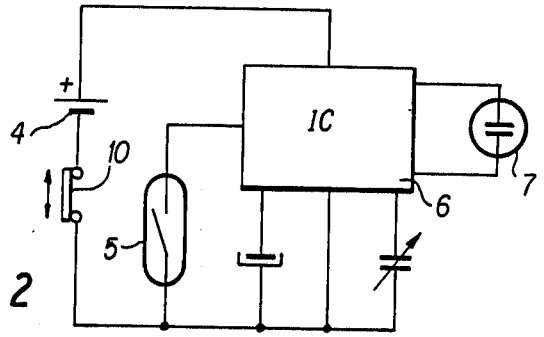
FIG. 2 is a schematic diagram of the circuitry of the electronic component of the present invention.
Figure 3:
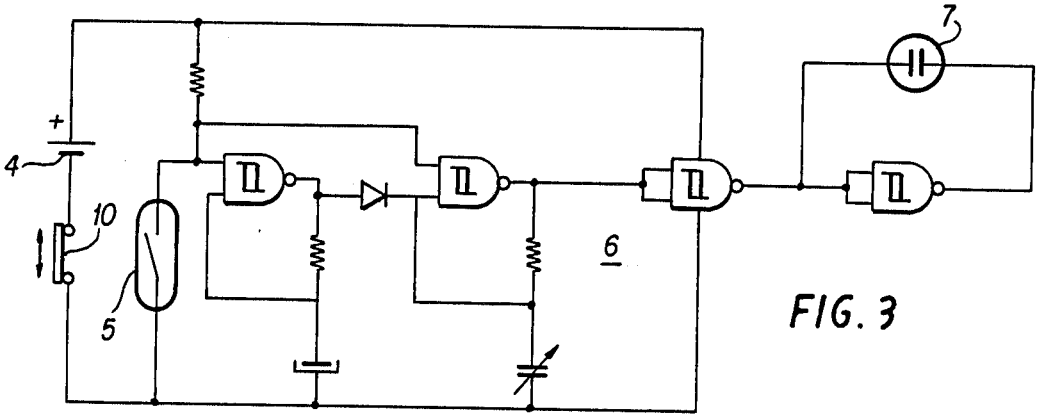
FIG. 3 is the circuit diagram of the electronic component of the present invention.
Figure 4:
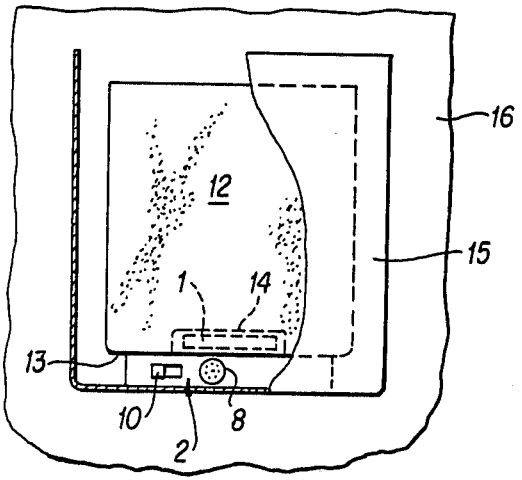
FIG. 4 is a perspective view of the present invention in place to prevent theft.

FIG. 2 shows three principal parts of component 2, a battery 4, a reed switch 5 and a audio producing device 6. The battery 4 is of the 1.25 to 1.5 volt type commonly used in digital watches or clock and small calculators. While a single battery is adequate to serve the purpose of the invention, an additional battery may be included in the circuit. As seen in FIG. 3, ther use of NAND GATES with SCHMITT TRIGGERS allows the use of a type of reed switch 5 which is held in the closed position by the presence of the magnetic field. The audio device 6 is piezoelectric transducer 7 which receives the electric signal generated when switch 5 is opened and converts this electric signal to an audio signal in a manner substantially the same as a telephone receiver. The audio signal is emitted from a buzzer or small speaker 8 which may be mounted within the housing of the component 2 or it may an alarm 9 external to the housing 3 of component 2 and connected thereto by external conductors 11. Optionally, the circuit of component 2 may have a slide switch 10 as shown to deactivate the component 2 so the user can remove the wallet for his own purposes.

To use the anti-theft device, the magnet 1 is placed in the wallet 12 at the fold 13 of the wallet and preferably in a pocket 14 for such purpose. The slide switch 10 on component 2 is in the open position and the component is then placed in the users pocket or purse. The wallet is then placed in the pocket 15 of a coat 16 or purse touching housing 3, and the slide switch 10 is then removed to the closed position thus completing the circuit of component 2 except for activating reed switch 5. When the wallet falls out of the pocket or puse, or a would be thief attempts to remove the wallet from the pocket or purse, the movement of the wallet a pre-determined distance from housing 3 with the resultant diminishment of the electromagnetic field, the switch 5 will open thus activating the audio signal. When the wallet is to be removed by the owner, slide switch 10 is moved to the open position and then the wallet may be removed from the pocket or purse without activating the audio signal.

Such changes or modifications in the size or shape of the magnet and circuit as may occur to those of skill in the electronic art, including microcircuitry, are considered to come within the scope of the present invention as defined in the following claims.

What is claimed is:

1. A freely transportable anti-theft device for an article such as a wallet or like element comprising a magnetic field generator which is placed within and unattached to any article to be protected and an audio producing component which is placed in and unattached to a purse or clothing pocket containing the to-be-protected article, the generator acting as a trigger to activate said audio producing component when said generator is separated a pre-determined distance from said audio producing component.

2. The device according to claim 1 where said component includes a disabling switch to permit separation of said component and said trigger beyond said pre-determined distance without actuation of said component.

3. The device according to claim 1 wherein said magnetic field generator comprises a thin elongated magnet placed in a wallet.

4. The device according to claim 1 wherein said audio producing component comprises a battery-powered electronic circuit with a magnetically sensitive reed switch and a piezoelectric transducer generating an audio signal.

5. The device according to claim 1 wherein said audio producing component is contained in a housing which is placed in the pocket or purse in contact with said wallet.

6. The device according to claim 1 wherein said audio producing component comprises a battery-powered electronic circuit with a magnetically sensitive reed switch contained within a housing and a piezoelectric transducer generating an audio signal external to said housing and connected to said circuit by electrical conductors, said housing and transducer being placed in the pocket or purse in contact with said wallet.

* * * * *